US008317292B2

(12) United States Patent
Murray et al.

(10) Patent No.: US 8,317,292 B2
(45) Date of Patent: Nov. 27, 2012

(54) METHOD OF POSITION DETECTION WITH TWO-DIMENSIONAL SENSOR IN PRINTER

(75) Inventors: Richard A. Murray, San Diego, CA (US); James J. Haflinger, San Diego, CA (US); Gary A. Kneezel, Webster, NY (US); Juan M. Jimenez, Escondido, CA (US)

(73) Assignee: Eastman Kodak Company, Rochester, NY (US)

( * ) Notice: Subject to any disclaimer, the term of this patent is extended or adjusted under 35 U.S.C. 154(b) by 420 days.

(21) Appl. No.: 12/636,807

(22) Filed: Dec. 14, 2009

(65) Prior Publication Data

US 2011/0141182 A1 Jun. 16, 2011

(51) Int. Cl.
*B41J 29/393* (2006.01)

(52) U.S. Cl. ..... 347/19

(58) Field of Classification Search ..... 347/19; 101/484; 358/3.26; 400/708
See application file for complete search history.

(56) References Cited

U.S. PATENT DOCUMENTS

| | | | | |
|---|---|---|---|---|
| 5,564,848 | A * | 10/1996 | Quintana | 400/708 |
| 6,158,344 | A * | 12/2000 | Walker et al. | 101/484 |
| 6,805,425 | B2 | 10/2004 | Hayashi et al. | |
| 7,147,316 | B2 | 12/2006 | Hayashi et al. | |
| 7,275,799 | B2 | 10/2007 | Hayashi et al. | |
| 7,399,129 | B2 | 7/2008 | Writt | |
| 2007/0188815 | A1 * | 8/2007 | Donovan et al. | 358/3.26 |
| 2009/0021552 | A1 * | 1/2009 | Fletcher et al. | 347/19 |
| 2009/0160894 | A1 | 6/2009 | Barnard et al. | |

* cited by examiner

*Primary Examiner* — Stephen Meier
*Assistant Examiner* — Carlos A Martinez
(74) *Attorney, Agent, or Firm* — Peyton C. Watkins

(57) ABSTRACT

A method for monitoring relative position of a carriage and a recording medium in an inkjet printing system having a roller for advancing the recording medium along a recording medium advance direction, the method includes sending light from a light source toward at least a portion of the roller; receiving reflected light in a two-dimensional sensor mounted on the carriage; sending a signal from the two-dimensional sensor to a controller, wherein the signal indicates the pattern of reflected light received by the two-dimensional sensor; comparing the received signal by the controller to a signal stored in memory; and calculating a shift between the received signal and the signal stored in memory.

20 Claims, 13 Drawing Sheets

METHOD OF POSITION DETECTION WITH TWO-DIMENSIONAL SENSOR IN PRINTER

CROSS-REFERENCE TO RELATED APPLICATION

Reference is made to commonly assigned, co-pending U.S. patent application Ser. No. 12/636,806, filed Dec. 14, 2009 herewith, entitled "Position Detection with Two-Dimensional Sensor in Printer", by Richard A. Murray, et al.

FIELD OF THE INVENTION

This invention relates generally to the field of inkjet printing, and in particular to a method for detecting the relative position of the printhead and the recording medium in the printer.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device that changes the wall geometry of the ink pressurization chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a recording medium advance direction by rotating a feed roller and then stopped. While the recording medium is stopped, the printhead carriage is moved in a carriage scan direction that is substantially perpendicular to the recording medium advance direction as the drops are ejected from the nozzles. After the carriage has printed a swath of the image while traversing the recording medium, the recording medium is advanced, the carriage direction of motion is reversed, and the image is formed swath by swath.

Conventionally the position of the carriage along the carriage scan direction is monitored by a linear encoder, and the amount of rotation of the feed roller is monitored by a rotary encoder. Such monitoring of the carriage and the feed roller is used by the printer controller to control the firing of droplets from the array of drop ejectors, and to control the amount of feed roller rotation such that the desired image is printed on the recording medium. As is known in the art, sources of error can be introduced in the recording medium position after feed roller rotation, due for example to feed roller diameter errors, feed roller eccentricity, or recording medium slippage relative to the roller.

It is desired to accurately track the position of the carriage and the amount of recording medium advance with fewer sensors. U.S. Pat. No. 7,275,799 by Hayashi et.al. discloses the use of a carriage-mounted two-dimensional sensor to track both carriage position and paper feed amount by illuminating the paper with coherent light (for example from a semiconductor laser), monitoring the motion of a speckle pattern (interference pattern) with the two-dimensional sensor, and multiplying by a predetermined coefficient. A limitation however, is that for printing of some documents, such as borderless photographs, the illuminated region goes off the paper on at least one side of the paper as the carriage is scanned back and forth during printing. In some cases the surface of the platen can be used to generate a speckle pattern so that carriage motion can still be monitored, even if the illumination region is no longer on the paper. If the paper is not in the region of illumination, however, '799 only provides for controlling the amount of paper feed using the average of previous feed amounts.

The monitoring of paper feed by tracking the motion of a speckle pattern from an idle roller is disclosed in U.S. Pat. No. 7,147,316 (also by Hayashi et. al.). In this approach, the idle roller is in contact with the paper being fed. A surface of the roller is illuminated by a laser and the motion of the speckle pattern of the rotating idle roller is detected by a two-dimensional sensor, where both the laser and the two-dimensional sensor are mounted in fixed position relative to the roller. In other words, they are not carriage mounted. Thus, the idle roller remains illuminated for back and forth carriage passes. With a carriage mounted laser and two-dimensional sensor as disclosed in '799, as well as a stationary mounted laser and two-dimensional sensor as disclosed in '316 both carriage position and paper feed amount can be tracked even for borderless printing (at least until the trail edge of the paper is no longer in contact with the idle roller).

Competitive inkjet printer market pressures require functionality at lower cost. What is needed is a method for monitoring the carriage position and the recording medium feed amount with a single sensor even for borderless printing. A method of using the single sensor to inspect print test patterns would provide additional advantages.

SUMMARY OF THE INVENTION

The present invention is directed to overcoming one or more of the problems set forth above. Briefly summarized, according to one aspect of the invention, the invention resides in a method for monitoring relative position of a carriage and a recording medium in an inkjet printing system having a roller for advancing the recording medium along a recording medium advance direction, the method comprising (a) sending light from a light source toward at least a portion of the roller; (b) receiving reflected light in a two-dimensional sensor mounted on the carriage; (c) sending a signal from the two-dimensional sensor to a controller, wherein the signal indicates the pattern of reflected light received by the two-dimensional sensor; (d) comparing the received signal by the controller to a signal stored in memory; and (e) calculating a shift between the received signal and the signal stored in memory.

DETAILED DESCRIPTION OF THE INVENTION

Figure 1:
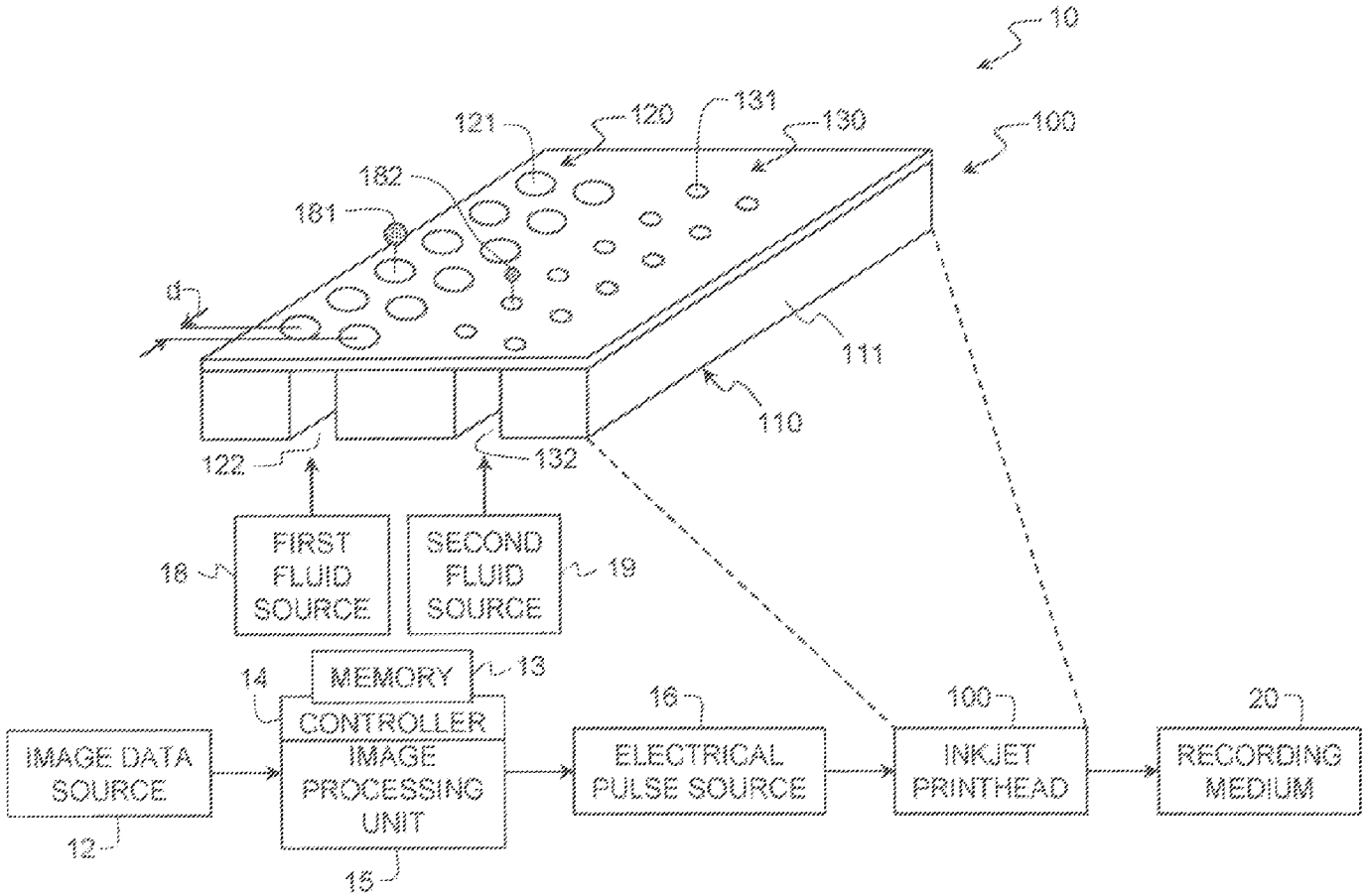
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

Each nozzle array is in fluid communication with a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20. As the nozzles are the most visible part of the drop ejector, the terms drop ejector array and nozzle array will sometimes be used interchangeably herein.

Figure 2:
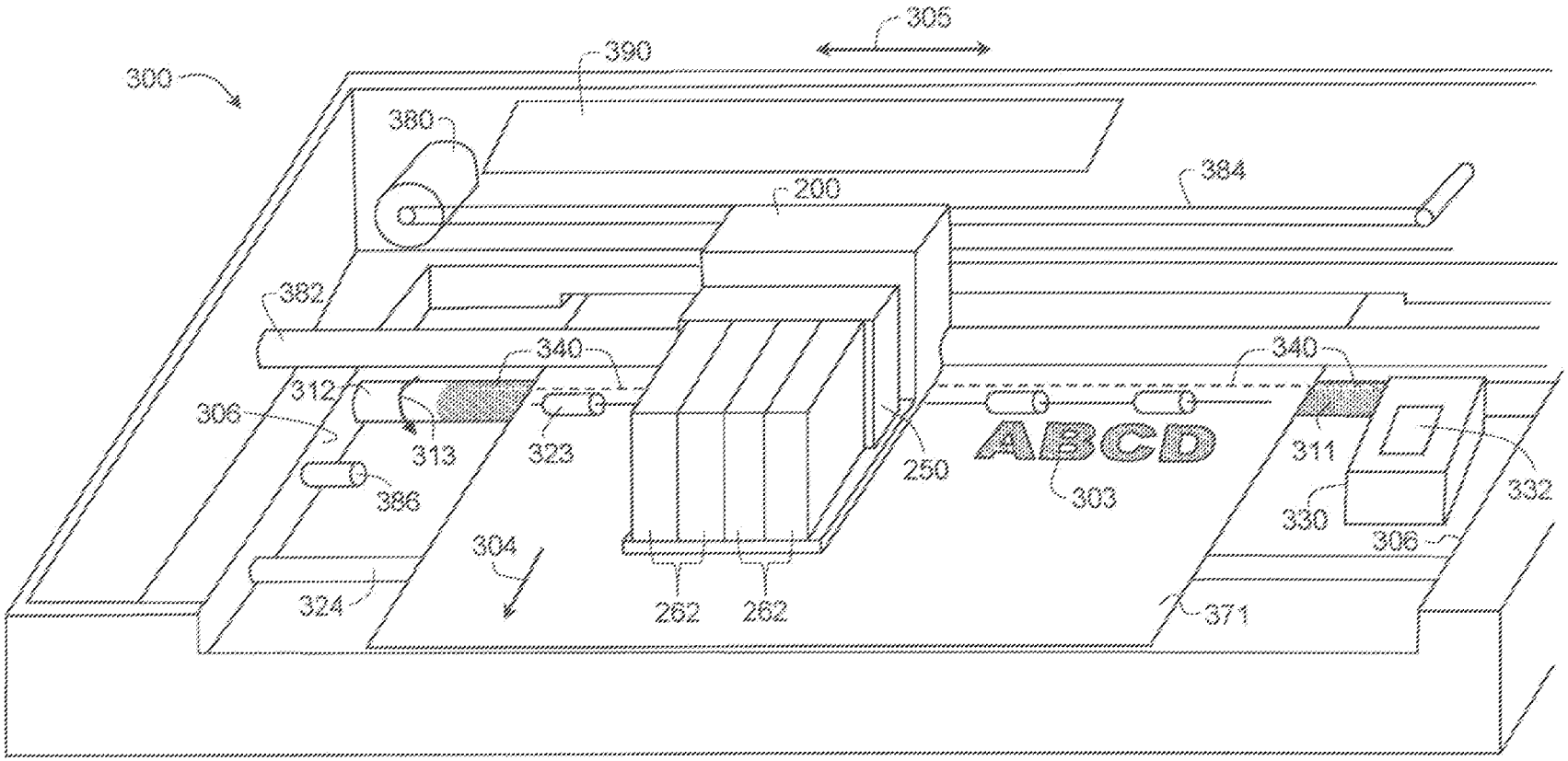
FIG. 2 is a schematic perspective view of a portion of a carriage printer according to an embodiment of the invention.

FIG. 2 shows a schematic perspective view of a portion of a desktop carriage printer according to an embodiment of the present invention. Some of the parts of the printer have been hidden in the view shown in FIG. 2 so that other parts can be more clearly seen. Printer chassis 300 has a print region 303 across which carriage 200 is moved back and forth in carriage scan direction 305 while drops of ink are ejected from printhead 250 that is mounted on carriage 200. The letters ABCD indicate a portion of an image that has been printed in print region 303 on a piece 371 of paper or other recording medium. Carriage motor 380 moves belt 384 to move carriage 200 along carriage guide rod 382.

Printhead 250 is mounted in carriage 200, and ink tanks 262 are mounted to supply ink to printhead 250, and contain inks such as cyan, magenta, yellow and black, or other recording fluids. Optionally, several ink tanks can be bundled together as one multi-chamber ink supply, for example, cyan, magenta and yellow. Inks from the different ink tanks 262 are provided to different nozzle arrays.

A variety of rollers are used to advance the recording medium through the printer. In the view of FIG. 2, feed roller 312 and passive roller(s) 323 advance piece 371 of recording medium along media advance direction 304, which is substantially perpendicular to carriage scan direction 305 across print region 303 in order to position the recording medium for the next swath of the image to be printed. Feed roller 312 is rotatably mounted with a bracket (not shown) at side walls 306. A portion of feed roller 312 (indicated as gray in FIGS. 2 and 3) is provided with a grit surface 311 to substantially eliminate slippage of the recording medium relative to the grit surface 311 of the feed roller 312. Passive rollers 323 are positioned just downstream (relative to a forward rotation direction 313) of the top of the feed roller 312 in the example of FIGS. 2 and 3, but they could alternatively be positioned upstream of the top of the feed roller 312. In any case, the passive rollers 323 hold the piece 371 of recording medium in intimate contact with the grit surface 311 of feed roller 312. For simplicity, the passive rollers 323 are shown as transparent in FIGS. 2 and 3, although they are typically not transparent. Discharge roller 324 continues to advance piece 371 of recording medium toward an output region where the printed medium can be retrieved. Star wheels (not shown) hold piece 371 of recording medium against discharge roller 324. Motor axle 386 extends from a media advance motor (not shown). A drive gear (not shown) mounted on motor axle 386 engages gears (not shown) on feed roller 312 and discharge roller 324, such that rotation of motor axle 386 causes feed roller 312 and discharge roller 324 to rotate the same amount as each other in the same direction, for example forward rotation direction 313. An illumination zone 340 is shown as a white band along the length of the top of feed roller 312 and as a dashed line on piece 371 of recording medium. Illumination zone 340 will be described in more detail below.

Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the piece 371 of recording medium. Following the printing of a swath, the recording medium 20 is advanced along media advance direction 304.

Toward the rear of the printer chassis 300, in this example, is located the electronics board 390, which includes cable connectors for communicating via cables (not shown) to the printhead carriage 200 and from there to the printhead 250. Also on the electronics board are typically mounted a processor and/or other control electronics (shown schematically as controller 14 and image processing unit 15 in FIG. 1) for controlling the printing process, and an optional connector for a cable to a host computer.

Toward the right side of the printer chassis 300, in the example of FIG. 2, is the maintenance station 330. Maintenance station 330 can include a wiper (not shown) to clean the nozzle face of printhead 250, as well as a cap 332 to seal against the nozzle face in order to slow the evaporation of volatile components of the ink.

Figure 3:
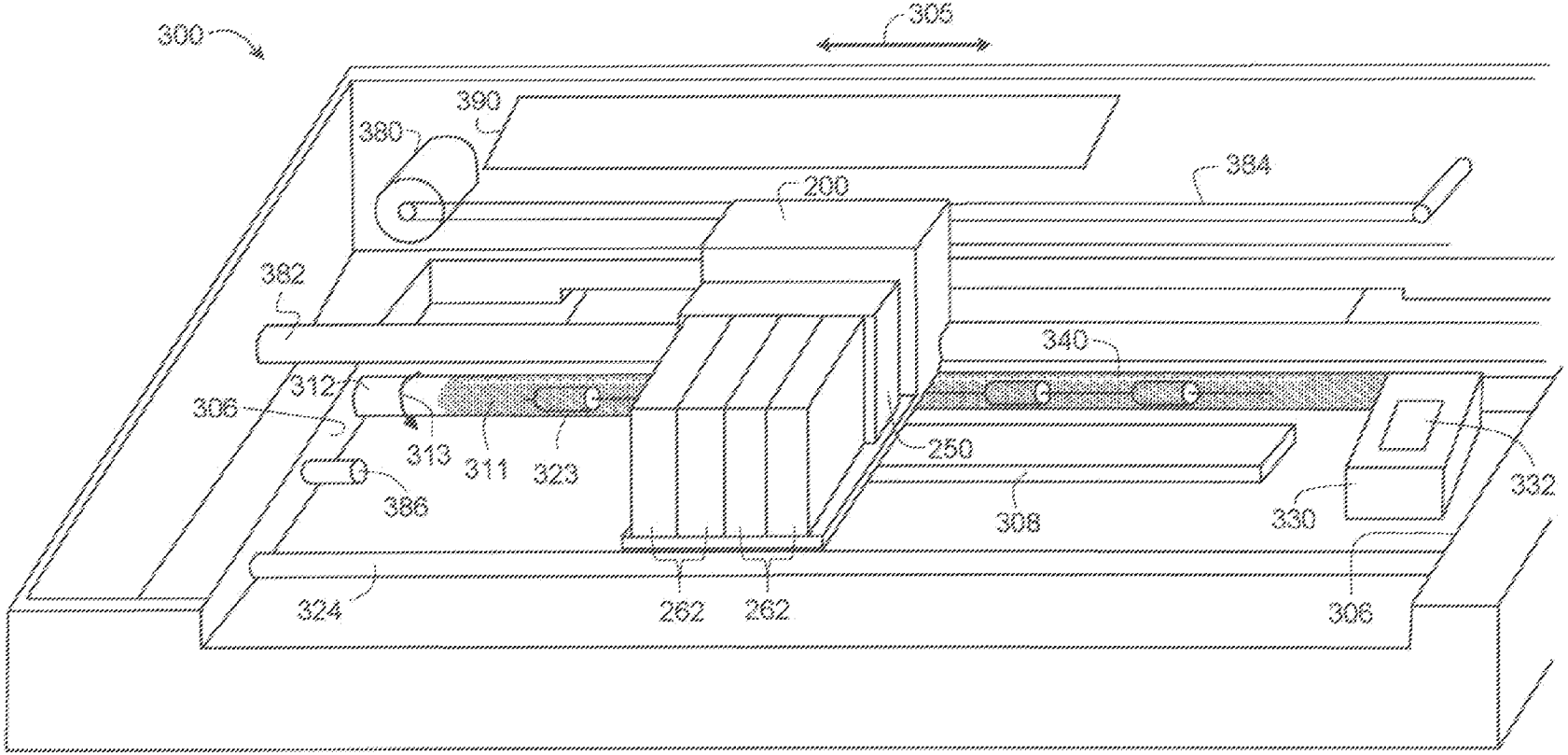
FIG. 3 is a schematic perspective view similar to FIG. 2, but with no recording medium in the printing region.

FIG. 3 is similar to FIG. 2, but with no recording medium present in the printing region. A greater portion of both feed roller 312 (including grit surface 311) and discharge roller 324 is thus visible in FIG. 3. Illumination zone 340 is shown as a white band along the length of the top of feed roller 312 in FIG. 3, and will be described in more detail below. A portion of platen 308 is shown in FIG. 3 at the right hand side of carriage 200. Platen 308 also extends to the left of carriage 200, but that portion is not shown in FIG. 3 in order not to obscure other details. Platen 308 helps to support the recording medium in the print region 303 (see FIG. 2). For inkjet printing systems designed for borderless printing, platen 308 typically includes a plurality of ribs (not shown) on which the recording medium is supported as a flat plane, as well as an absorbent medium (not shown) that is recessed relative to the ribs in order to absorb ink that is ejected beyond the edge of the recording medium.

Figure 4:
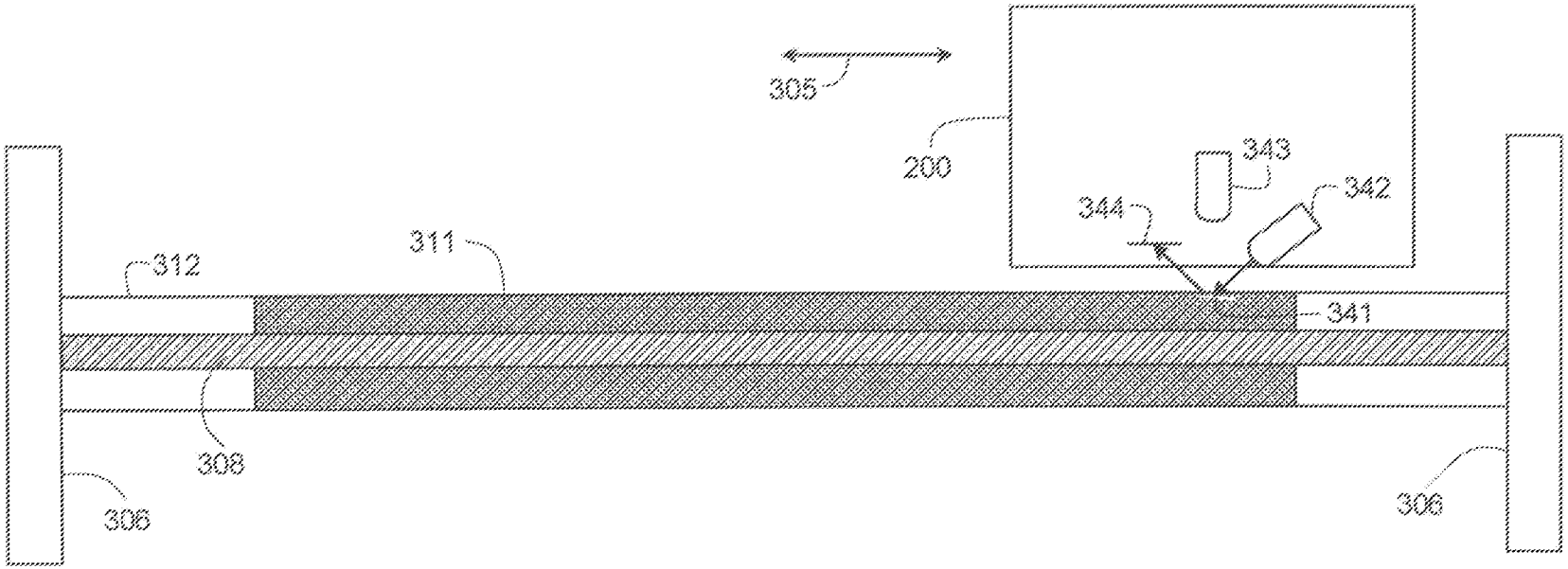
FIG. 4 shows a schematic side view of the feed roller and carriage according to an embodiment of this invention.

FIG. 4 shows a schematic side view of feed roller 312 and carriage 200 according to an embodiment of this invention. Mounted on carriage 200 is light source 342 and two-dimensional sensor 344. As carriage 200 is moved along carriage scan direction 305 (which is substantially parallel to the axis of feed roller 312), light source 342 provides an illuminated region 341. Second light source 343 is an optional light source as will be described below. The arrow pointing from light source 342 toward feed roller 312 represents light provided by light source 342, while the arrow pointing from feed roller 312 toward two-dimensional sensor 344 represents light reflected from feed roller 312. The illuminated region 341 travels along the carriage scan direction 305 as carriage 200 is moved back and forth for forming a moving window of an illuminated region. Illumination zone 340 of FIGS. 2 and 3 includes the entire moving window set of illuminated regions 341 as the light source 342 moves along with the carriage. Because piece 371 of recording medium is passing over the top of feed roller 312 in FIG. 2, the illumination zone 340 includes portions (represented by the dashed line in FIG. 2) that are on the piece 371 recording medium when the recording medium is in the optical path between light source 342 and two-dimensional sensor 344, as well as portions (represented by the white band) that are on feed roller 312. When no recording medium is present in the optical path between light source 342 and two-dimensional sensor 344 (as in FIG. 3), the entire illumination zone 340 is on feed roller 312. More generally, it is not required that illumination zone 340 be located at the top of the feed roller 312. It is preferred that illumination zone 340 be located in a region near the passive rollers 323, such that the illumination zone 340 is in a region where the piece 371 of recording medium makes intimate contact with feed roller 312, but the optical path for reflected light between light source 342, feed roller 312 and two-dimensional sensor 344 is not obscured by the presence of the passive rollers 323 (i.e. the passive rollers 323 are not in the optical path between light source 342 and two-dimensional sensor 344).

An advantage of the present invention relative to prior art patents U.S. Pat. No. 7,147,316 and U.S. Pat. No. 7,275,799 referred to above is that a single two-dimensional sensor (344) is able to monitor motion of the carriage as well as motion of the recording medium (either directly or indirectly) regardless of whether the illuminated region 341 includes only the recording medium, only the feed roller, or both the recording medium and the feed roller. Such a system is thus compatible with making borderless prints, and only requires a single two-dimensional sensor.

In FIG. 4, a particular mounting configuration of light source 342 and two-dimensional sensor 344 is shown. In this example, the plane of two-dimensional sensor 344 is substantially parallel to the plane of platen 308, and therefore is also substantially parallel to the plane of a piece 371 of recording medium in the print region 303 (see FIG. 2). Also, in the example of FIG. 4, the illuminated region 341 is on the top of feed roller 312, i.e. on a region of feed roller 312 that is substantially parallel to the plane of platen 308. Moreover, in this example, light source 342 is configured to emit light along a direction having a component along carriage scan direction 305 (i.e., the light is emitted substantially along the axis of feed roller 312). Further, with reference to FIGS. 2 and 3, light source 342 is configured to emit light to a location that is upstream of the print region 303. In other word, as the lead edge of the piece 371 of recording medium is advanced along media advance direction 304, it reaches illumination zone 340 before it reaches print region 303 (i.e. in normal operation recording medium in the illumination zone is not yet printed). Similarly, the trail edge of the piece 371 of recording medium will exit illumination zone 340 while printhead 250 is still printing on print region 303. In addition to being upstream of print region 303, illuminated region 341 can be configured either to be to the left side or to the right side of the nozzles of the printhead 250. In other words, in some embodiments, illuminated region 341 will go off the left side of piece 371 recording medium while the printhead 250 is still printing on the recording medium. In other embodiments, illuminated region 341 will go off the right side of piece 371 recording medium while the printhead 250 is still printing on the recording medium. In summary, at various times during the printing process the illuminated region 341 will be on only feed roller 312, or only on piece 371 of recording medium, or on both the feed roller and the recording medium (i.e. with an edge of the piece 371 of recording medium in the illuminated region 341).

Other embodiments can have different mounting configurations of the light source 342 and two-dimensional sensor 344. For example, rather than directing the light substantially along the axis of cylindrical feed roller 312 (i.e. with a component along the carriage scan direction 305), the light source 342 can be configured to direct light substantially perpendicular to the axis of feed roller 312, as will be described below. Also, rather than having two-dimensional sensor 342 being substantially parallel to platen 308, it can be oriented, for example substantially perpendicular to specularly reflected light (i.e. at an angle from the normal to the illumination zone 340 that is equal to the angle between the light source 342 and the normal to the illumination zone 340).

Figure 5B:
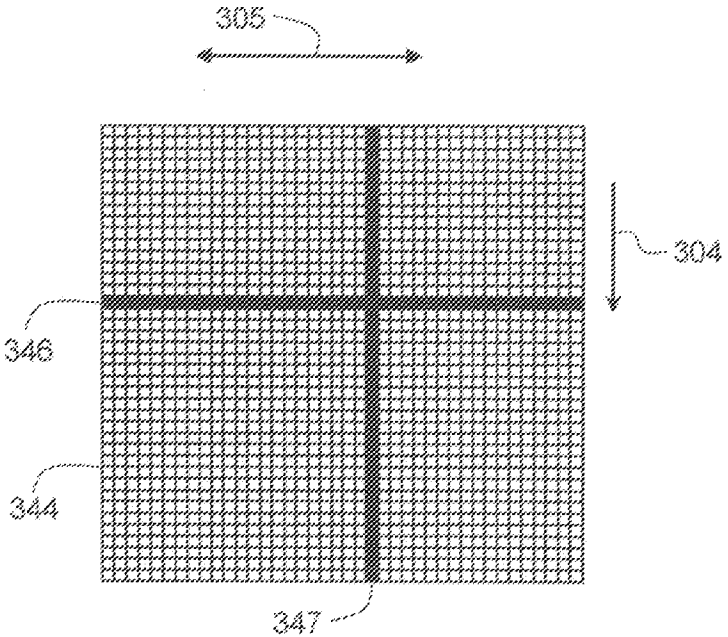
FIGS. 5A and 5B show schematic views of a two-dimensional sensor according to an embodiment of this invention.
Figure 5A:
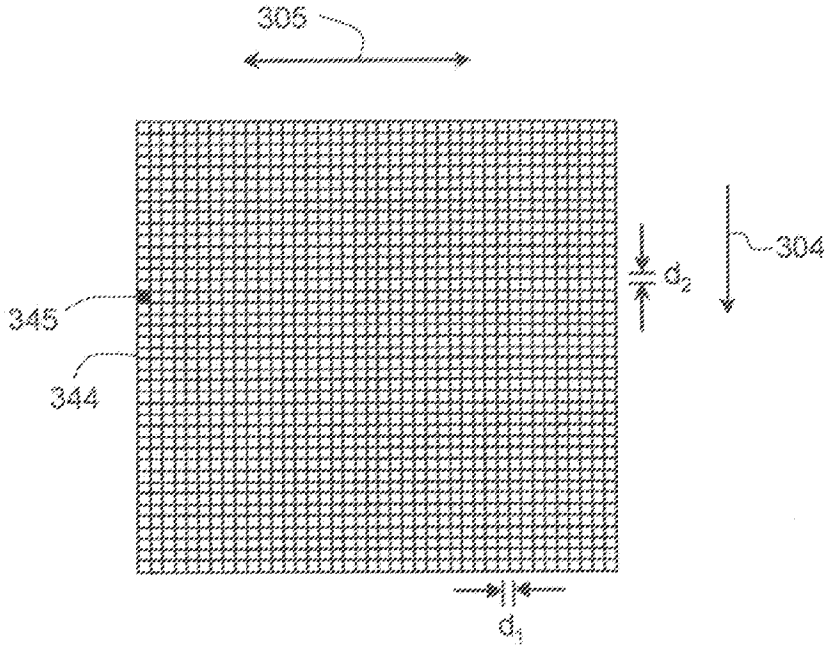

FIGS. 5A and 5B show schematic views of two-dimensional sensor 344. Two-dimensional sensor 344 includes a plurality of rows (such as row 346) and columns (such as column 347) of photosensors 345, where a particular row, column or photosensor is indicated in these figures by making it black. In the example shown, the rows 346 are oriented substantially parallel to carriage scan direction 305 and the columns 347 are oriented substantially parallel to media advance direction 304. Photosensors 345 have a center to center spacing of $d_1$ along the carriage scan direction 305 and a center to center spacing of $d_2$ along the media advance direction 304. In an actual two-dimensional sensor, the photosensor 345 can have dimensions on the order of $d_1$=5 microns and $d_2$=5 microns. The entire sensing region can be on the order of 1 mm by 1 mm (i.e. 200 rows by 200 columns) or 2 mm by 2 mm (i.e. 400 rows by 400 columns) for example.

Light reflected from the illuminated region 341 will produce light intensity patterns that depend on the surface roughness characteristics, the macroscopic shape (i.e. flat or round), and the reflectance of the object (feed roller 312, piece 371 of recording medium, or both) in the field of view of the two-dimensional sensor 344. The light intensity patterns will also depend on whether there are interference patterns, particularly if the light is coherent (i.e. if light source 342 is a laser), and also on whether there are optical elements such as lenses in the optical path between the light source 342, the illuminated region 341, and the two-dimensional sensor 344.

Figure 6B:
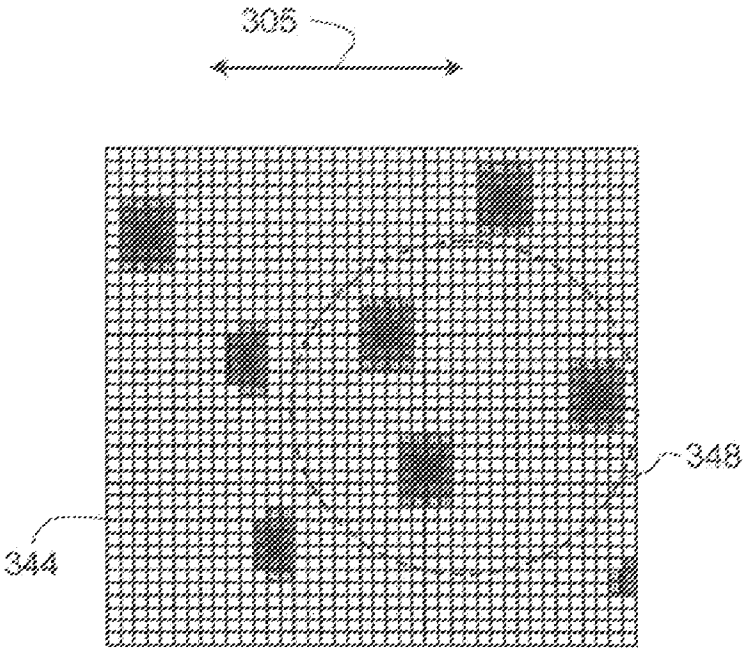
FIGS. 6A and 6B schematically show movement along the carriage direction of a characteristic reflection pattern from a piece of recording medium according to an embodiment of this invention.
Figure 6A:
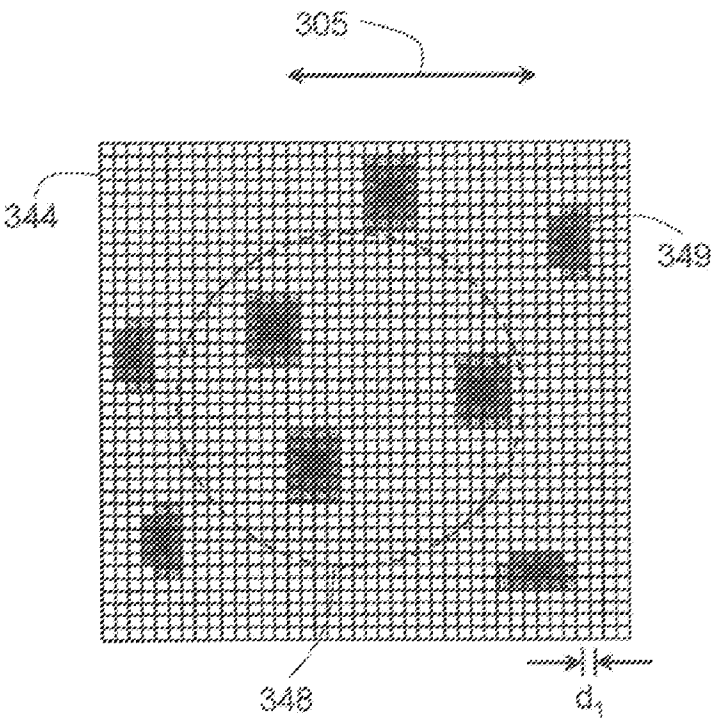

A series of "snapshots" at constant time intervals are taken by the two-dimensional sensor and its associated electronics. Light intensity patterns are converted into electrical signal patterns by the two-dimensional array of photosensors 345. The electrical signal patterns are recognized and monitored for movement in successive snapshots. Movement of the patterns detected in the two-dimensional sensor 344 is then converted to relative motion of the object(s) in the field of view of the two-dimensional sensor 344, as measured by the number of rows or columns that the pattern moved, the center-to-center spacing of the photosensors 345, any reduction or magnification factors due to optical elements such as lenses in the optical path, and a shape correction factor to be described below. Electrical signals corresponding to the movement of light intensity patterns are provided from the two-dimensional sensor to the controller 14 (see FIG. 1). Controller 14 processes the electrical signals and uses them to control carriage motor 380 for positioning the carriage and the motor for advancing the feed roller 312 to advance the recording medium. In this way the relative position of the printhead 250 and the recording medium are monitored so that the printhead can eject ink drops at the proper timing and positions to form the desired image on the recording medium An example of light intensity pattern movement due to carriage motion along carriage scan direction 305 for the case of reflections from a flat recording medium surface with no motion along the medium advance direction 304 is shown in FIGS. 6A and 6B. FIG. 6A has a light intensity pattern including spots 349 of various shapes and sizes. Note the group of spots within reference region 348 on two-dimensional sensor 344. As the carriage 200 and carriage-mounted two-dimensional sensor 344 move toward the left with respect to a substantially flat region of piece 371 of recording medium, the characteristic reflection pattern from the recording medium moves toward the right on two-dimensional sensor 344 correspondingly. Comparing the snapshot of FIG. 6B to the snapshot of FIG. 6A, it can be seen that the characteristic reflection pattern within reference region 348 has moved eight columns of photosensors to the right, i.e. a distance of 8 $d_1$. Note that one spot 349 has moved completely off the right hand side of two-dimensional sensor 344 (i.e. exited the field of view), another spot has moved almost out of the field of view, and new spot has entered the field of view from the left. The sensor 344 sends a signal to a controller which signal indicates the pattern of reflected light received by the two-dimensional sensor for the present snapshot and stores the signal. This signal is compared by the controller 14 to a signal previously stored in memory 13 (See FIG. 1) corresponding to a previous snapshot. A shift is calculated (as described above) between the present signal and the previously stored signal stored in memory. Based on this shift, a distance the carriage has moved is then calculated. These steps are repeated iteratively while the carriage is moving until the carriage is stopped in a particular swath.

In general it is preferable to recognize a pattern of light intensity in a first snapshot not too near the edges of the usable field of view of two-dimensional sensor 344. Then in a second snapshot, compare the position of the recognized pattern to the position the pattern had in the first snapshot and calculate the amount and direction of motion accordingly. For a carriage velocity of 1 meter per second, if the time interval between snapshots is 100 microseconds, for example, and there are no optical reduction or magnification factors, the distance the carriage moves during the time interval between snapshots is 100 microns corresponding to about 20 columns of photosensors 345 if $d_1$=5 microns. If the usable field of view of the two-dimensional photosensor is significantly larger than 100 microns (for example 1 mm by 1 mm), there should be a reference region 348 having a recognizable pattern whose motion can be tracked from a first snapshot to a second snapshot without going outside the field of view. A pattern in a central reference region of the second snapshot can then be identified for comparison with its position in a third snapshot (not shown).

In actuality, the piece 371 of recording medium is not flat where it contacts the feed roller 312, but instead tends to conform to the cylindrical shape of the feed roller 312 in this region. However, for relative movement substantially parallel to the carriage scan direction 305 (i.e. substantially parallel to the axis of feed roller 312) movement of the light intensity patterns corresponds directly to motion of the carriage relative to the piece 371 of recording medium. This is because the angle between incident light and a line parallel to the feed roller axis does not change along the feed roller axis.

Figure 7B:
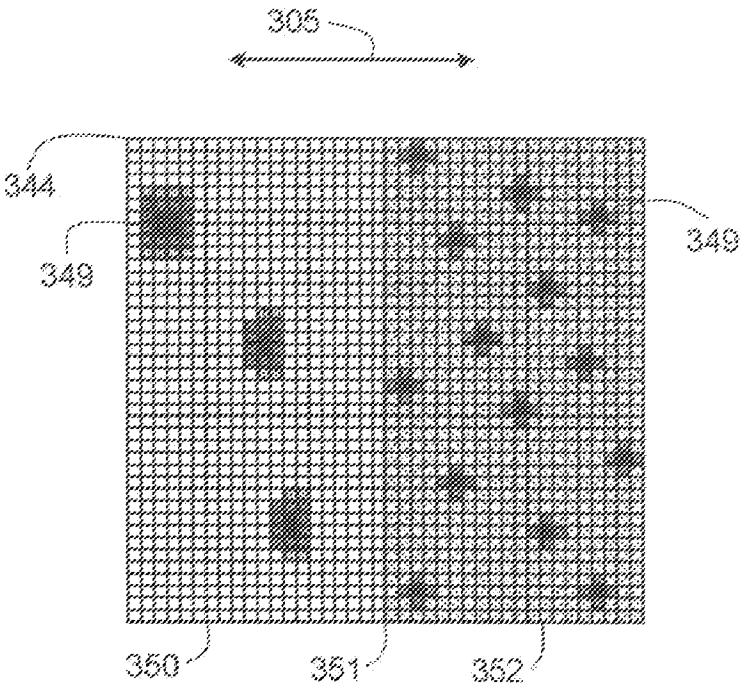
FIG. 7B schematically shows a characteristic reflection pattern from a feed roller grit surface and a piece of recording medium according to an embodiment of this invention.
Figure 7A:
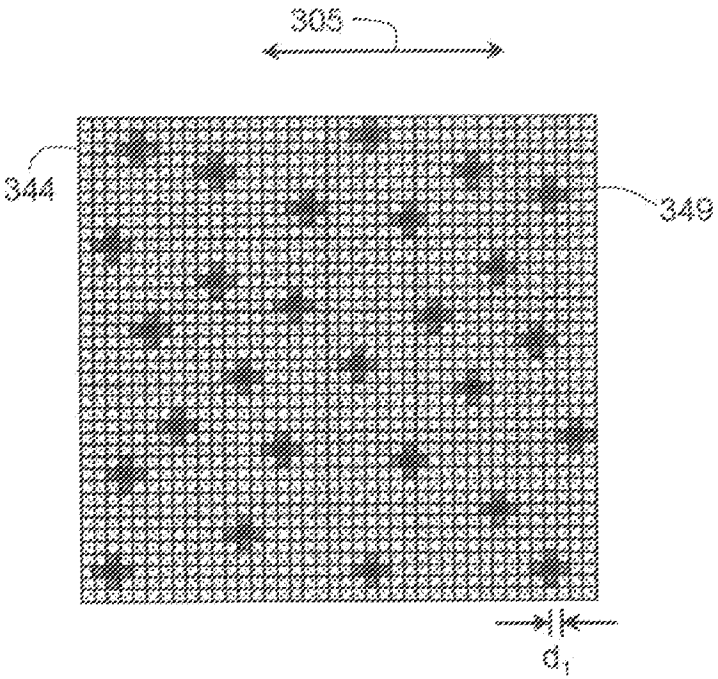
FIG. 7A schematically shows a characteristic reflection pattern from a feed roller grit surface according to an embodiment of this invention.

Detection of carriage motion when the illuminated region 341 is beyond the edges of piece 371 of recording medium (i.e. when it is on the feed roller 312) is done in the same way as described above relative to FIGS. 6A and 6B. However, because both the surface roughness and the reflectance of the gray-colored grit region 311 of feed roller 312 are different than on the white paper or other recording medium, both the background reflected light intensity and the characteristic scattered light patterns tend to be different for reflections from the feed roller 312 and for piece 371 of recording medium. FIG. 7A schematically illustrates the lower background reflected light intensity (gray rather than white), and different patterns of spots 349 than for FIGS. 6A and 6B. For example, the spots due to grit surface reflections can have a different typical size, shape and/or spatial frequency. FIG. 7B schematically illustrates the case of both the piece 371 of recording medium and the feed roller 312 being in the optical path between light source 342 and two-dimensional sensor 344. Because of the different background reflected light intensity and characteristic scattered light patterns in recording medium reflection region 350 versus roller reflection region 352, it is possible to detect an edge 351 corresponding to a side edge of piece 371 of recording medium.

Figure 8B:
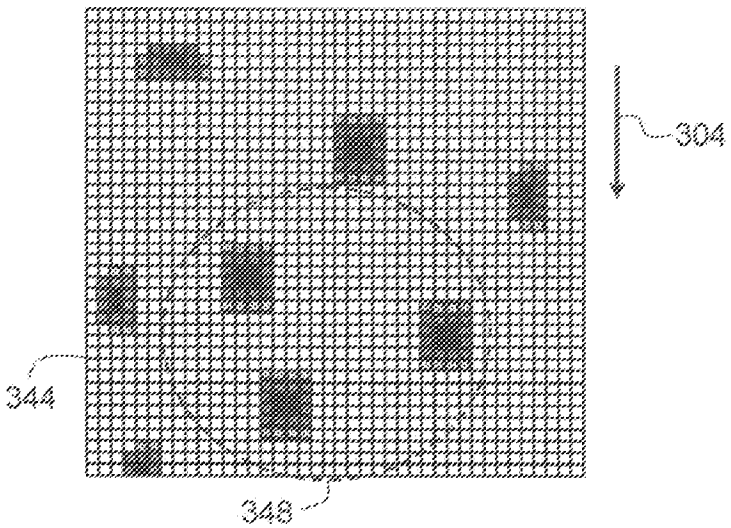
FIGS. 8A and 8B schematically show movement along the media advance direction of a characteristic reflection pattern from a flat piece of recording medium according to comparative example.
Figure 8A:
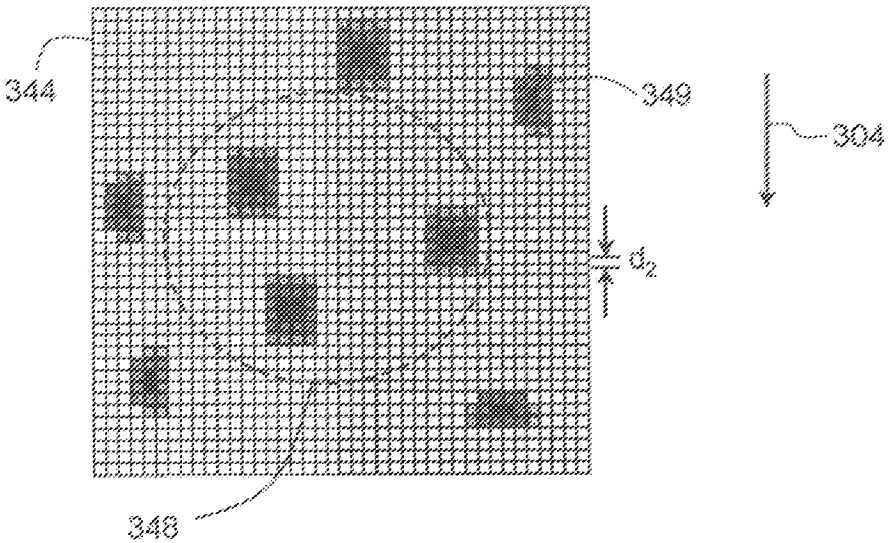

A comparative example of light intensity pattern movement due to recording medium movement along media advance direction 304 for the case of reflections from a flat recording medium surface with no carriage motion along the carriage scan direction 305 is shown in FIGS. 8A and 8B. A reference region 348 somewhat centrally located within two-dimensional sensor 344 is shown in this example in the first snapshot of FIG. 8A. In the second snapshot of FIG. 8B, the recognized pattern has moved 8 rows down, i.e. a distance of 8 $d_2$. If there are no optical reduction or magnification factors, the distance 8 d2 corresponds to the distance that the flat recording medium has advanced in the media advance direction 304 between snapshots. Note that this comparative example is different in quantitative detail from embodiments of the invention as described below (though similar qualitatively), because the piece 371 of recording medium tends to conform to the cylindrical shape of the feed roller 312 where the two are in contact.

Before describing the movement of light intensity patterns corresponding to media advance for cylindrically shaped recording medium or cylindrical feed roller in the field of view of the two-dimensional sensor, it is useful to consider the specular reflection of light from a cylindrical surface and how it differs from specular reflection from a flat plane. FIG. 9A schematically shows an end view of feed roller 312 with a flat piece 371 of recording medium (corresponding to the comparative example described above) that is positioned over feed roller 312. A light source 342 emits light 375 at an angle a with respect to the normal 374 to the plane of the recording medium. If the two-dimensional sensor 344 is a distance d from the plane of the flat recording medium and is parallel to that plane, then specularly reflected light 376 strikes the two-dimensional sensor 344 a distance 2 d sin α away from the light source. Rays striking the flat recording medium a distance x apart will hit the two-dimensional sensor a distance x apart. Similarly, if the recording medium is moved relative to the two dimensional sensor 344 by a distance x, the characteristic reflection pattern also moves on the two-dimensional sensor 344 by the distance x, if there are no reduction or magnification optics.

Figure 9B:
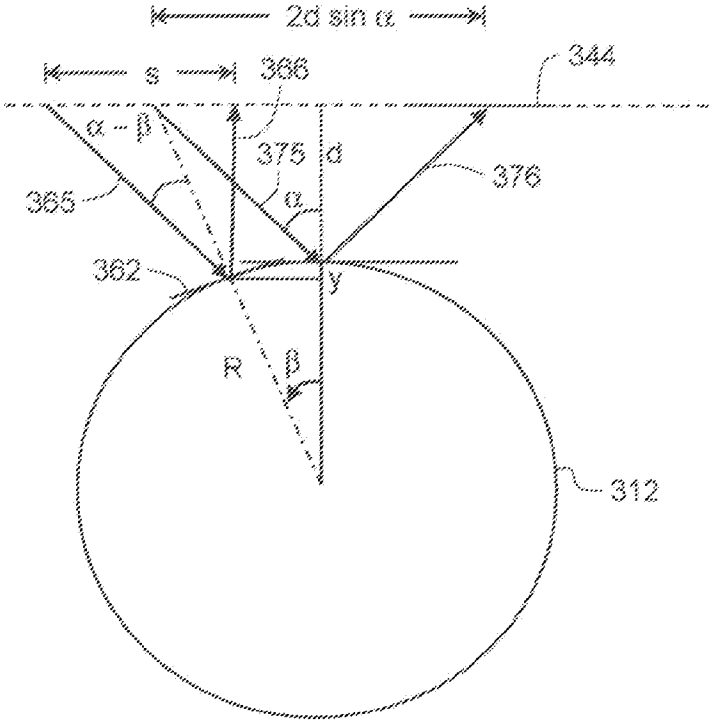
FIG. 9B schematically shows reflections from a cylindrical surface according to an embodiment of the invention.
Figure 9A:
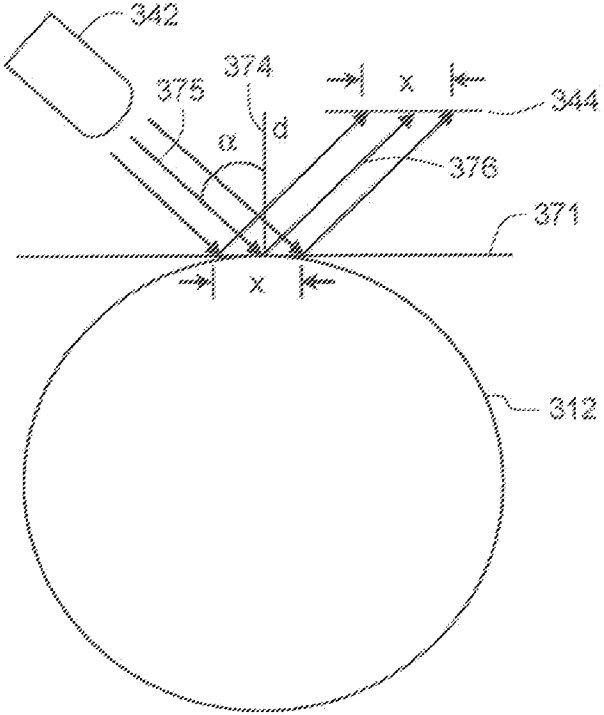
FIG. 9A schematically shows reflections from a flat surface according to a comparative example.

FIG. 9B schematically shows light reflection from a cylindrical surface (either the feed roller 312 or a region of recording medium conforming to the shape of the feed roller 312), for the case where the light from light source 342 is directed substantially radially toward the feed roller 312 rather than substantially axially along feed roller 312. When feed roller 312 is rotated by an angle β (measured in radians), the piece 371 of recording medium is advanced a distance D=βR, where R is the radius of feed roller 312. However, the characteristic reflection pattern on the two-dimensional photosensor 344 does not move by D=βR as will be demonstrated. For clarity, in FIG. 9B, β is shown larger than angles that would typically be used. In particular, in FIG. 9B, β is roughly 23 degrees (about 0.4 radians), while typical angles of interest would typically range from about −0.2 to 0.2 radians. Incident ray 375 strikes the top of feed roller 312 (i.e. at β=0). The top of feed roller 312 has a tangent that is parallel to two-dimensional sensor 344. Thus, as in FIG. 9A, the specularly reflected ray 376 strikes the two-dimensional sensor 344 a distance 2 d sin α away from the light source, where d is substantially equal to the distance from the two-dimensional sensor 344 to the feed roller 312. Incident ray 365 also is directed parallel to incident ray 375. However, incident ray 366 strikes a point on the cylindrical surface that is an angle away from the top of the roller. (In this example, β is positive if it is counterclockwise rotation from the top of the roller.) The tangent 362 to the cylindrical surface at this point has a normal (the dashed/dotted line) at an angle of (α−β) with respect to incident ray 365. The normal to tangent 362 has a length (d+y)/cos β, where y=R(1−cos β). Thus, the distance x that specularly reflected ray 366 would hit the plane (dotted line) defined by two-dimensional sensor 344 is given by:

$$x=2((d+R(1-\cos\beta))/\cos\beta)\sin(\alpha-\beta). \quad \text{(Eq. 1)}$$

For small angles β, it can be shown that:

$$x\sim 2d(\sin\alpha-(\beta\cos\alpha)). \quad \text{(Eq. 2)}$$

For sufficiently large angles β, specularly reflected ray 366 does not even hit two-dimensional sensor 344 (as is the case in FIG. 9B).

A particular region of feed roller 312 results in a characteristic reflection pattern on two-dimensional sensor 344 when that region is at the top of the feed roller (β=0). Relative to the light source, this characteristic reflection pattern is centered a distance $x_1$=2 d sin α. If the feed roller 312 is rotated by β, the characteristic reflection pattern is centered at a distance $x_2$ given by Eq. 1. The distance the characteristic reflection pattern moves on two dimensional sensor 344 is $\Delta x=x_1-x_2=2d\sin\alpha-2((d+R(1-\cos\beta))/\cos\beta)\sin(\alpha-\beta)$. For small angles β, Eq. 2 indicates that movement of the characteristic reflectance pattern is Δx~2 d (β cos α). Movement of the recording medium however is Rβ.

Figure 10:
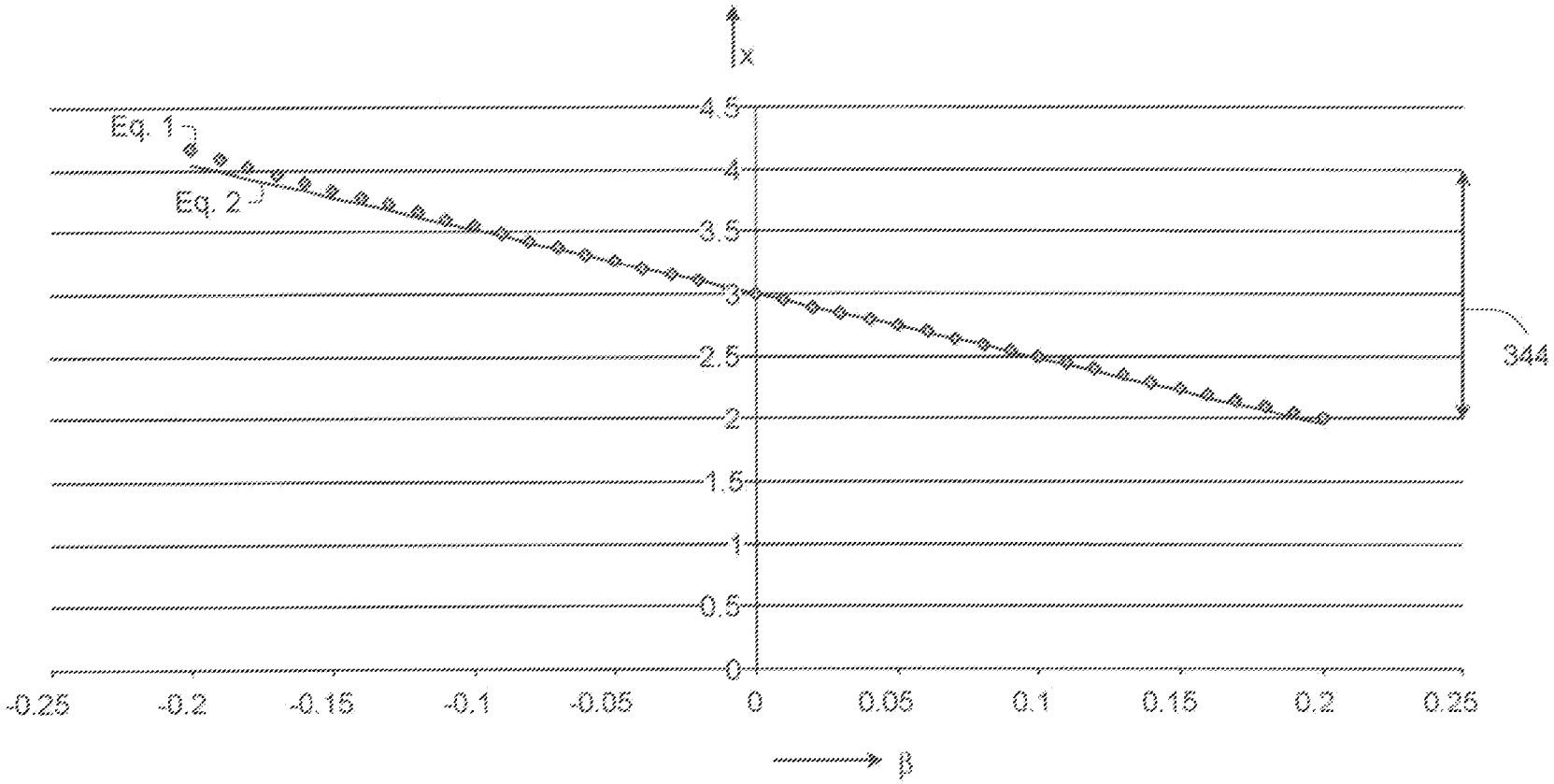
FIG. 10 is a graph of the movement of a characteristic reflection pattern along the media advance direction due to reflection from a cylindrical surface according to an exemplary embodiment.

In an exemplary embodiment, the radius of feed roller 312 is 4 mm, and the distance d from the plane of two-dimensional sensor 344 to the top of feed roller 312 is 3 mm. Light is directed at an angle=30 degrees (π/6 radians) with respect to the normal to the top of the feed roller 312 (i.e. 30 degrees with respect to vertical). The two-dimensional sensor 344 is 2 mm by 2 mm and is centered a distance 2 d sin α=3 mm from the light source. FIG. 10 shows a plot of x versus β according to Eq. 1 (diamond shaped markers) and approximation Eq. 2 (line) for β ranging from −0.2 to 0.2 radians. Eq. 1 deviates more from Eq. 2 for negative values of β than it does for equivalent magnitude of positive values of β. Since two-dimensional sensor 344 is centered at x=3 mm and has a dimension of 2 mm by 2 mm, it extends from x=2 mm to x=4 mm. Rays that are incident by negative angles having a magnitude of more than about 0.18 radians are specularly reflected beyond the edge of two-dimensional sensor 344. For angles within the range of approximately −0.06 radian to 0.08 radian, Eq. 1 is approximated well by Eq. 2. For the corresponding central rows of photosensors on two-dimensional sensor 344 the amount $R\beta$ of recording medium movement (corresponding to a feed roller rotation of $\beta$), can be related to the approximate movement of the characteristic reflection pattern $\Delta x \sim 2\ d\ (\beta \cos \alpha)$, so that recording medium movement is $R\beta \sim R\ \Delta x/(2\ d \cos \alpha)$.

Thus, for movement along the carriage scan direction 305, the amount of relative motion of the recording medium (or the feed roller 312) and the carriage (including the printhead it carries) is the same as the movement of a characteristic reflection pattern in successive snapshots, whether or not the piece 371 of recording medium is in the field of view, or the feed roller 312 is in the field of view, or both are in the field of view of two-dimensional photosensor 344. By contrast, a shape correction factor (such as $R/(2\ d \cos \alpha)$) needs to be used to convert movement of the characteristic reflection pattern to recording medium movement along the media advance direction 304. The shape correction factor can be stored in controller 14 (see FIG. 1) and used by controller 14 for making calculations of recording medium movement. Even when trail edge of piece 371 of recording medium has left contact with feed roller 312, and recording medium contact is only being made with discharge roller 324 (FIGS. 2 and 3), because feed roller 312 and discharge roller 324 are driven off the same drive gear (not shown) on motor axle 386, the same shape correction factor can be used for monitoring media advance if discharge roller 324 and feed roller 312 have the same radius R.

Figure 11:
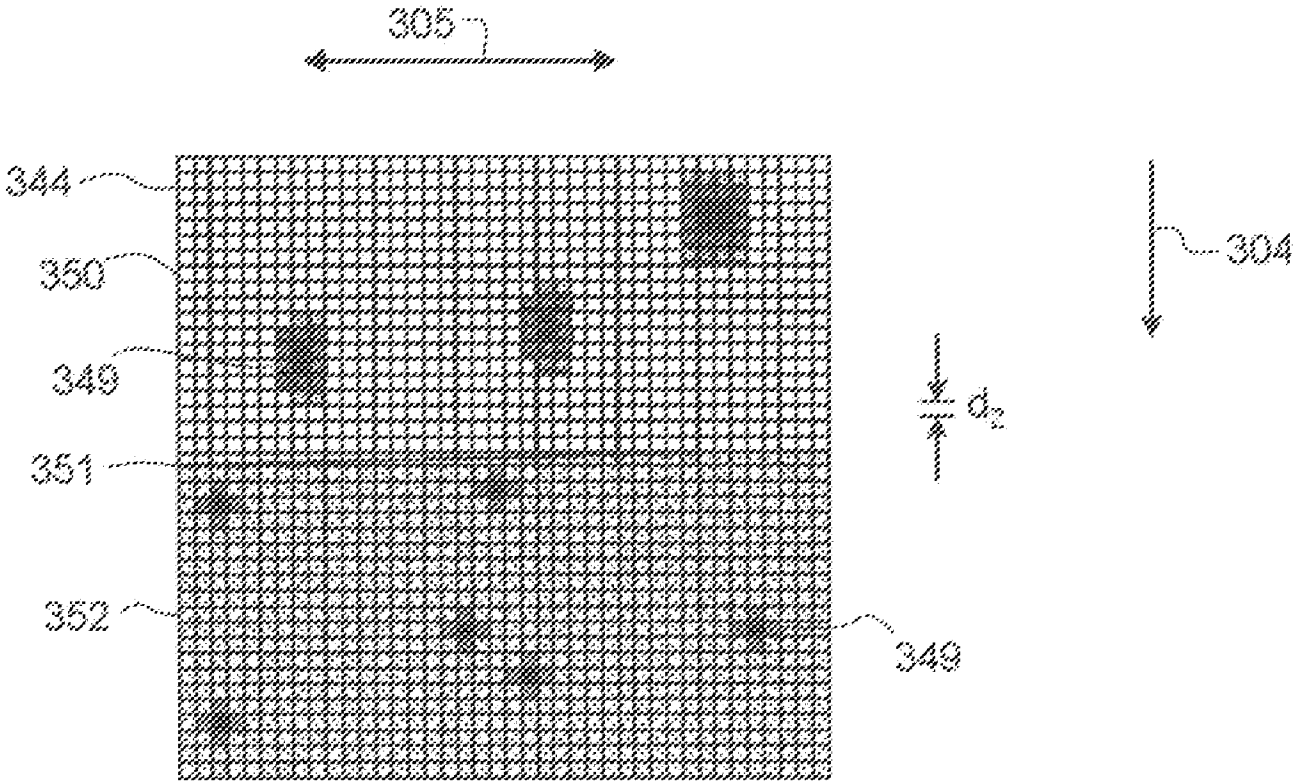
FIG. 11 schematically shows a characteristic reflection pattern from a feed roller grit surface and a piece of recording medium according to an embodiment of the present invention.

In a similar way that a side edge of piece 371 can be detected (as illustrated in FIG. 7B), where edge 351 is a side edge, the lead and trail edges of piece 371 of recording medium can also be detected, as shown schematically in FIG. 11. In this example, edge 351 is a lead edge. In FIG. 11, both the piece 371 of recording medium and the feed roller 312 are in the optical path between light source 342 and two-dimensional sensor 344. Because of the different background reflected light intensity and characteristic scattered light patterns in recording medium reflection region 350 versus roller reflection region 352, it is possible to detect edge 351 corresponding to lead edge of piece 371 of recording medium. It can be important to note the position of such edges in order to properly position the image on the recording medium. In the example shown in FIG. 11, the edge 351 between the white region 350 (representing the recording medium) and the gray region 352 (representing the roller) is not aligned with a row of the two-dimensional sensor 344. This can be due to a slight misorientation of the two-dimensional sensor 344 with respect to carriage scan direction 305, or it can be due to skew of piece 371 of recording medium. In order to distinguish between misorientation of the two-dimensional sensor and skew of the recording medium, the position of edge 351 is tracked as the carriage is scanned along carriage scan direction 305. If edge 351 does not move as captured by the sensor 344, then the sensor 344 is misoriented physically on the carriage relative to carriage scan direction 305. If edge 351 moves up or down as captured by sensor 344, then the recording medium is skewed by an amount related to the number of rows the edge 351 moves up or down for a given amount of carriage motion along carriage scan direction 305. This information can then be fed back to image processing unit 15 of controller 14 (see FIG. 1), in order to rotate the image accordingly so that the printed image is properly oriented on the recording medium.

Not only can two-dimensional sensor 344 be used to monitor the position of the carriage 200 and the printhead 250 that it carries along carriage scan direction, and motion of the recording medium along media advance direction 304, it can also be used to monitor print quality by inspecting print test patterns that are printed for printhead alignment, bad nozzle detection, etc.

Figure 12:
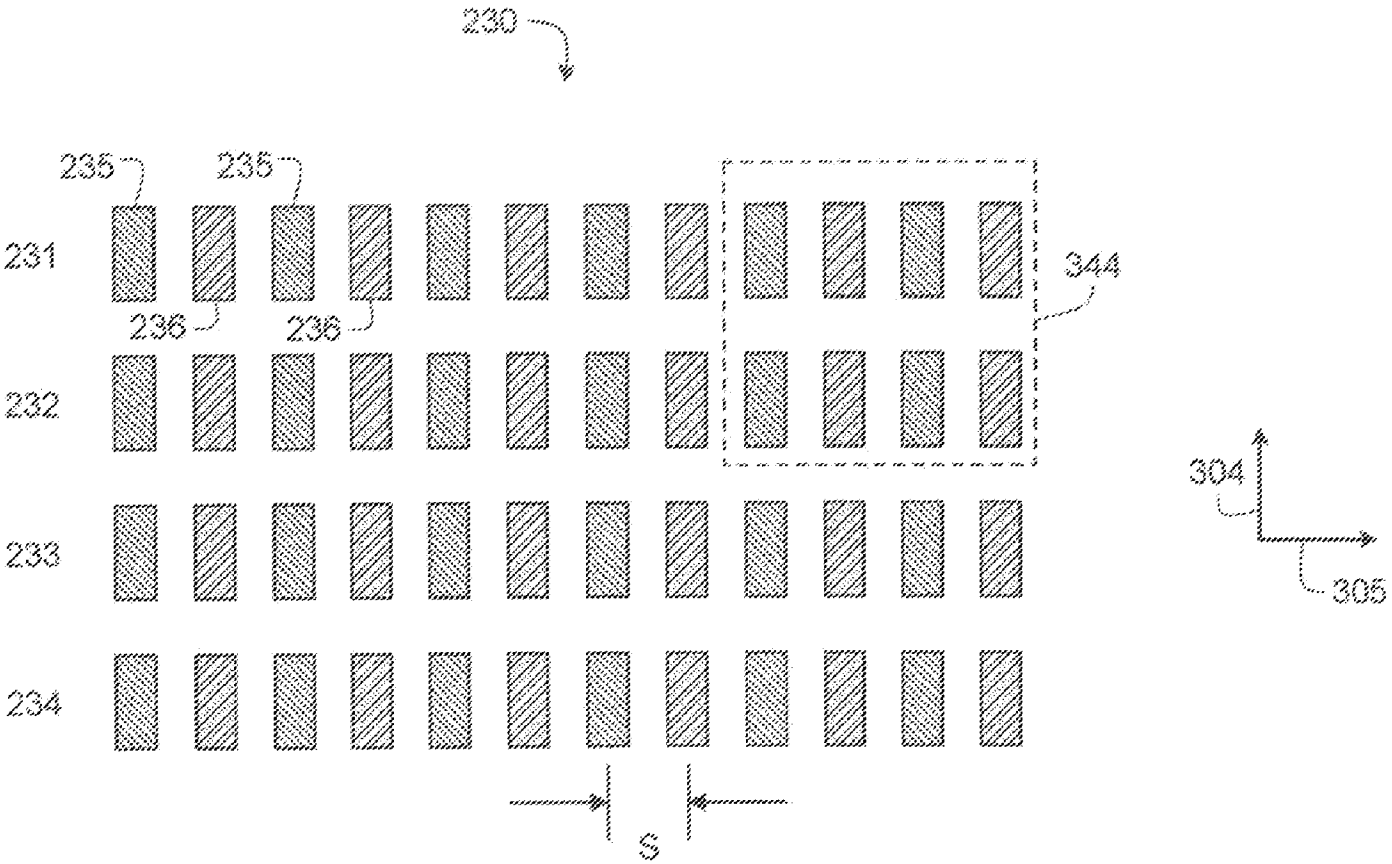
FIG. 12 is a printed alignment pattern that can be inspected using the two-dimensional sensor according to an embodiment of the present invention.

FIG. 12 shows a representation of a type of print test pattern that can be used for various types of alignment. The alignment pattern 230 of FIG. 12 includes a plurality of rows (231, 232, 233, 234) of first type bars 235 and second type bars 236, where the first type bars 235 and the second type bars 236 are alternated within the rows. A first type bar 235 is displaced from its neighboring second type bar 236 within a row along the carriage scan direction 305. Rows are displaced from each other along the media advance direction 304. Different types of alignment will use different specifications for what a first type bar 235 and a second type bar 236 should be. For color to color alignment (or array to array alignment) the first type bars 235 will be printed by inkjet nozzles corresponding to a first color or a first array, while the second type bars 236 will be printed by inkjet nozzles corresponding to a second color or a second array. For bidirectional alignment, the first type bars 235 may be printed by a group of inkjet nozzles while the carriage is moving from left to right, while the second type bars 236 may be printed by the same group of inkjet nozzles while the carriage is moving from right to left. For angular alignment, the first type bars 235 may be printed by a group of inkjet nozzles near one end of the array of inkjet nozzles, while the second type bars 236 may be printed by a group of inkjet nozzles near the other end of the array of inkjet nozzles. For odd-even alignment, the first type bars 235 may be printed by nozzles in one row of a nozzle array, and the second type bars 236 may be printed by nozzles in another row of the nozzle array. Although the alignment patterns differ in detail, the goal is to find the average center-to-center distance S between a first type bar 235 and its neighboring second type bar 236 to a high degree of accuracy.

To inspect the test pattern such as that shown in FIG. 12, (since the printing zone 303 is downstream of the illumination zone 340, as seen in FIG. 2), the printed piece 371 of recording medium needs to be backed up until the test pattern is in the illuminated field of view of the two-dimensional sensor 344 (dashed line box in FIG. 12). This can be done by reversing the rotation direction of motor axle 386 so that feed roller 312 rotates in a direction opposite to forward direction 313. Once the test pattern has been aligned relative to two-dimensional sensor 344, the carriage 200 can be scanned along carriage scan direction 305. Microscopic surface roughness of the recording medium can be used to provide a characteristic reflection pattern that successive snapshots can use to monitor movement along carriage scan direction 305. The regions that are printed with ink will have a different reflectance than the white paper, which can also be detected by the two-dimensional sensor and used by controller 14 to calculate the distance S between neighboring bars of the test pattern. In order for the two-dimensional sensor 312 to clearly detect patterns printed by different color inks including cyan, yellow and magenta, it can be helpful to use a broader illumination spectrum than is available for example from a single laser. A second light source 343 (see FIG. 4) can optionally be used to illuminate the illuminated region 341 for inspection of print test patterns (either in addition to the first light source 342 or together with the first light source 342). In one embodiment, the first and second light sources are lasers having two different wavelengths. In another embodiment, the second light source 343 is a broad spectrum light source (such as a white light LED) that can be used for illuminating print test patterns. Of course, if the first light source 342 has a sufficiently broad spectrum (e.g. a white light LED or a bi-color LED), print test pattern inspection can be done for all ink colors using the first light source 342 and no second light source is needed.

Figure 13:
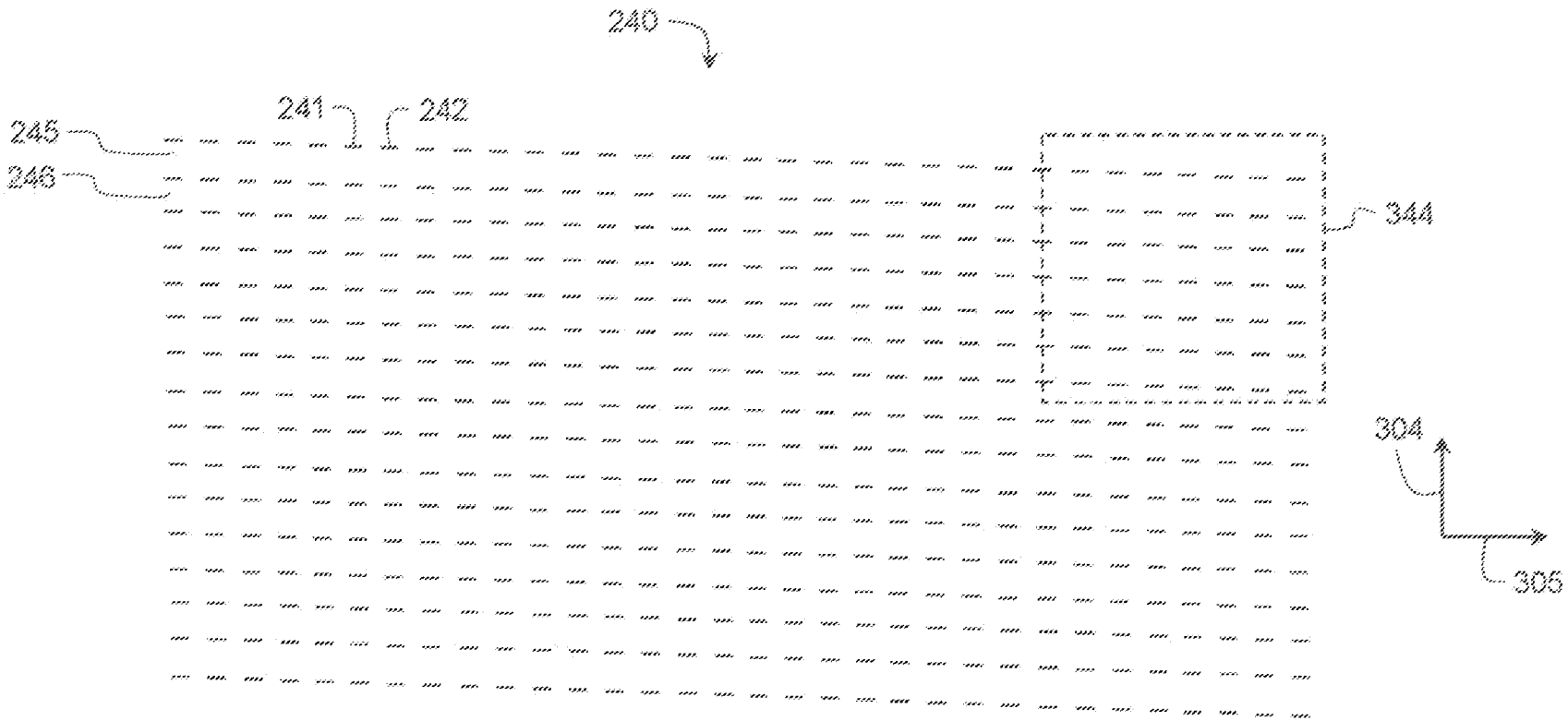
FIG. 13 is a print test pattern that can be inspected using the two-dimensional sensor according to an embodiment of the present invention.

Other types of print test patterns can similarly be inspected using the two-dimensional sensor 344. For example, a series of line segments each printed by a different nozzle in the printhead can be printed in a predetermined pattern to detect malfunctioning nozzles. Image data for the predetermined pattern can be stored in controller 14, for example. In the pattern 240 shown in FIG. 13, each nozzle prints a short line segment 241, 242, and etc. along carriage scan direction 305 at a known center-to-center spacing. The segments can be arranged in a plurality of rows 245, 246, and etc. where the rows are separated from each other along the media advance direction 304. The printed piece 371 of recording medium would need to be backed up in order to position the test pattern (or a portion of the test pattern) in the field of view of the two-dimensional sensor 344. Then the carriage 200 would be scanned in the carriage scan direction 305 and the two-dimensional sensor 344 would provide signals to controller 14 to detect the presence or absence of line segments based on light intensity patterns from light reflected from the print test pattern. Absent line segments (relative to line segments known to be present in the predetermined pattern) correspond to malfunctioning nozzles. Similarly, misdirected jets can be detected by comparing the position of line segments to their known positions in the predetermined pattern. Mispositioned line segments correspond to misdirected jets. Further, malfunctioning jets that are providing drop sizes that are either too large or too small can be detected by comparing dot sizes or line widths of the line segments to their known nominal dot sizes or line widths in the predetermined pattern.

In summary, the invention resides in a method for monitoring relative position of a carriage and a recording medium in an inkjet printing system having a roller for advancing the recording medium along a recording medium advance direction, the method comprising: (a) sending light from a light source toward at least a portion of the roller; (b) receiving reflected light in a two-dimensional sensor mounted on the carriage; (c) sending a signal from the two-dimensional sensor to a controller, wherein the signal indicates the pattern of reflected light received by the two-dimensional sensor; (d) comparing the received signal by the controller to a signal stored in memory; (e) calculating a shift between the received signal and the signal stored in memory; (f) calculating a distance the carriage has moved based on the shift; and (g) storing the received signal in memory; and (h) performing steps a through g while the carriage is moving in a swath along carriage scan direction.

The invention has been described in detail with particular reference to certain preferred embodiments thereof, but it will be understood that variations and modifications can be effected within the spirit and scope of the invention.

PARTS LIST

10 Inkjet printer system
12 Image data source
13 Memory
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
230 Alignment pattern
231 Row of alignment bars
232 Row of alignment bars
233 Row of alignment bars
234 Row of alignment bars
235 First type alignment bar
236 Second type alignment bar
240 Bad jet detection pattern
241 Line segment printed by a first jet
242 Line segment printed by a second jet
245 Row of line segments
246 Row of line segments
250 Printhead
262 Ink tank
300 Printer chassis
303 Print region
304 Media advance direction
305 Carriage scan direction
306 Wall
308 Platen
311 Grit surface
312 Feed roller
313 Forward rotation direction (of feed roller)
323 Passive roller(s)
324 Discharge roller
330 Maintenance station
332 Cap
340 Illumination zone
341 Illuminated region
342 Light source
343 Second light source
344 Two-dimensional sensor
345 Photosensor
346 Row
347 Column
348 Reference region
349 Spot
350 Recording medium reflection region
351 Edge
352 Roller reflection region
362 Tangent
365 Incident ray
366 Specularly reflected ray
371 Piece of recording medium
374 Normal
375 Incident ray
376 Specularly reflected ray
380 Carriage motor
382 Carriage guide rod
384 Belt
386 Motor axle
390 Electronics board

The invention claimed is:

1. A method for monitoring relative position of a carriage and a recording medium in an inkjet printing system having a cylindrical roller for advancing the recording medium along a recording medium advance direction, the method comprising:

(a) sending light from a light source mounted on the carriage toward at least a portion of the cylindrical roller;

(b) receiving reflected light from the at least the portion of the cylindrical roller in a two-dimensional sensor mounted on the carriage, wherein the two-dimensional sensor is displaced from the light source, and the two-dimensional sensor is oriented to receive specularly reflected light from the at least the portion of the cylindrical roller;

(c) sending a signal from the two-dimensional sensor to a controller, wherein the signal indicates the pattern of reflected light received by the two-dimensional sensor;

(d) comparing the received signal by the controller to a signal stored in memory;

(e) calculating a shift between the received signal and the signal stored in memory;

(f) calculating a distance the carriage has moved based on the shift.

2. The method as in claim 1 further comprising the step of:

(g) storing the received signal in memory.

3. The method as in claim 2 further comprising the step of:

(h) iteratively performing steps a through g while the carriage is moving in a swath along a carriage scan direction.

4. The method of claim 1, wherein the reflected light includes light reflected from the roller.

5. The method of claim 1, further comprising advancing the recording medium into contact with the roller prior to step (a), wherein the reflected light includes light reflected from the recording medium.

6. The method of claim 5, wherein the reflected light includes light reflected from unprinted recording medium.

7. The method of claim 5, further comprising detecting an edge of the recording medium.

8. The method of claim 7, wherein the edge is a side edge of the recording medium.

9. The method of claim 7, wherein the edge is a lead edge of the recording medium.

10. The method of claim 7, wherein the edge is a trail edge of the recording medium.

11. The method of claim 7, further comprising the step of detecting skew of the recording medium.

12. The method of claim 1, wherein the roller is moving and repeating step (a)-(e) and further comprising the step of calculating a distance the recording medium has moved based on the shift.

13. The method of claim 12, further comprising the step of storing the received signal in memory.

14. The method of claim 12, wherein the step of calculating a distance the recording medium has moved further comprises using a shape correction factor in the calculation.

15. The method of claim 1, wherein the recording medium includes a test target and further comprising the steps of positioning the test target relative to the two-dimensional sensor; and monitoring the print quality based on the received signal.

16. The method of claim 15, wherein the positioning the test target relative to the two-dimensional sensor further comprises moving the recording medium in a direction that is opposite to the recording medium advance direction.

17. The method of claim 15, wherein the test target includes dots printed in a predetermined pattern by a predetermined group of nozzles on the printhead, and wherein the step of monitoring the print quality further comprises determining whether dots are missing from the target.

18. The method of claim 15, wherein the test target includes dots printed in a predetermined pattern by a predetermined group of nozzles on the printhead, and wherein the step of monitoring the print quality further comprises determining whether dots are mispositioned relative to the predetermined pattern.

19. The method of claim 15, wherein the test target includes dots of a known nominal size in a predetermined pattern printed by a predetermined group of nozzles on the printhead, and wherein the step of monitoring the print quality further comprises determining whether sizes of printed dots differ from the known nominal size.

20. The method of claim 15, wherein the test target includes a first set of dots in a first predetermined pattern printed by a first predetermined group of nozzles and a second set of dots in a second predetermined pattern printed by a second predetermined group of nozzles, and wherein the step of monitoring the print quality further comprises calculating a distance between the first set of dots and the second set of dots.

* * * * *